US008723894B2

(12) United States Patent
Bae et al.

(10) Patent No.: US 8,723,894 B2
(45) Date of Patent: May 13, 2014

(54) DATA PROCESSING DEVICE HAVING A RGBW GENERATOR AND A FRAME RATE CONVERSION AND METHOD OF DRIVING THE SAME

(75) Inventors: Jae-Sung Bae, Suwon-si (KR); Jung-Hwan Cho, Goyang-si (KR); Hyun-Sik Yoon, Yongin-si (KR)

(73) Assignee: Samsung Display Co., Ltd. (KR)

( * ) Notice: Subject to any disclaimer, the term of this patent is extended or adjusted under 35 U.S.C. 154(b) by 559 days.

(21) Appl. No.: 12/610,425

(22) Filed: Nov. 2, 2009

(65) Prior Publication Data

US 2010/0265272 A1 Oct. 21, 2010

(30) Foreign Application Priority Data

Apr. 15, 2009 (KR) ..... 10-2009-0032563

(51) Int. Cl.
*G09G 5/10* (2006.01)

(52) U.S. Cl.
USPC ..... 345/690

(58) Field of Classification Search
USPC ..... 345/690, 89
See application file for complete search history.

(56) References Cited

U.S. PATENT DOCUMENTS

| | | | | |
|---|---|---|---|---|
| 5,844,535 | A * | 12/1998 | Itoh et al. | 345/92 |
| 2007/0024557 | A1 * | 2/2007 | Rho et al. | 345/88 |
| 2008/0238847 | A1 * | 10/2008 | Aiba et al. | 345/87 |
| 2009/0201418 | A1 * | 8/2009 | Endo et al. | 348/453 |

FOREIGN PATENT DOCUMENTS

| | | | |
|---|---|---|---|
| JP | 2007-328345 | A | 12/2007 |
| KR | 1020070014862 | A | 2/2007 |
| KR | 1020080054661 | A | 6/2008 |

* cited by examiner

*Primary Examiner* — Long D Pham
(74) *Attorney, Agent, or Firm* — Cantor Colburn LLP

(57) ABSTRACT

A method of processing data for driving a display panel including a pixel structure including red, green, blue and white (RGBW) sub-pixels includes receiving red, green and blue (RGB) data at a first frame frequency. The method further includes generating RGBW data at a second frame frequency, greater than the first frame frequency, using the RGB data.

19 Claims, 6 Drawing Sheets

DATA PROCESSING DEVICE HAVING A RGBW GENERATOR AND A FRAME RATE CONVERSION AND METHOD OF DRIVING THE SAME

This application claims priority to Korean Patent Application No. 2009-32563, filed on Apr. 15, 2009, and all the benefits accruing therefrom under 35 U.S.C. §119, the content of which in its entirety is herein incorporated by reference.

BACKGROUND OF THE INVENTION

1. Field of the Invention

The present invention relates to a method of processing data, a data processing device for performing the method of processing data and a display apparatus including the data processing device. More particularly, the present invention relates to a method of processing data with advantages that include, but are not limited to, displaying a high resolution image, as well as a data processing device for performing the method of processing data and a display apparatus including the data processing device.

2. Description of the Related Art

Generally, a liquid crystal display ("LCD") apparatus includes an LCD panel which displays an image thereon by controlling light transmittance of liquid crystal molecules. Typically, a backlight assembly is disposed under the LCD panel to provide the LCD panel with light.

LCD apparatuses have been employed in various display apparatuses, such as monitors for laptop computers and/or desktop computers, for example. In addition, the LCD apparatuses are more frequently being employed in large-size LCD televisions ("TVs"). Recently, an efficiency of displaying still images, such as text, for example, has been improved.

Moreover, next-generation LCD TVs may have resolutions four times (or more) than resolutions of current full high definition ("FHD"). Specifically, next-generation LCD TVs may have resolutions such as 3840×2160 or 4096×2160, for example. However, as the resolution of LCD panels increases, transmittance levels of the LCD panels decrease.

Accordingly, there is a need for an LCD panel having increased resolution without decreased transmittance. Thus, exemplary embodiments of the present invention include a red, green, blue and white ("RGBW") structure, a transmittance of which is substantially brighter, e.g., 50% brighter, than the transmittance of convention red, green and blue ("RGB") structured LCD panel. More particularly, as will be described in further detail below, the LCD panel including the RGBW structure has RGBW sub-pixels and displays a color image using a sub-pixel rendering technique. Thus, exemplary embodiments of the LCD including the RGBW structure are capable of more accurately displaying natural luminance and natural color.

BRIEF SUMMARY OF THE INVENTION

Exemplary embodiments of the present invention provide a method of processing data providing advantages which include, but are not limited to, displaying a substantially increased resolution image with substantially improved transmittance.

Exemplary embodiments of the present invention also provide a display apparatus for performing the above-mentioned method of processing data.

Exemplary embodiments of the present invention also provide a display apparatus including the above-mentioned data processing device.

According to an exemplary embodiment of the present invention, a method of processing data for driving a display panel including a pixel structure including red, green, blue and white ("RGBW") sub-pixels includes receiving red, green and blue ("RGB") data at a first frame frequency. The method further includes generating RGBW data at a second frame frequency using the RGB data. The second frame frequency is greater than the first frame frequency.

According to an alternative exemplary embodiment of the present invention, a data processing device includes a frame rate controller and an RGBW generator. The frame rate controller receives RGB data at a first frame frequency and processes the RGB data using motion estimation motion compensation (MEMC) to output processed RGB data at a second frame frequency greater than the first frame frequency. The RGBW generator converts the processed RGB data into RGBW data.

According to another alternative exemplary embodiment of the present invention, a data processing device includes an RGBW generator and a frame rate controller. The RGBW generator receives RGB data at a first frame frequency and converts the RGB data into converted RGBW data. The frame rate controller processes the converted RGBW data using MEMC to output RGBW data at a second frame frequency greater than the first frame frequency.

According to still another alternative exemplary embodiment of the present invention, a display apparatus includes a display panel, a main circuit part and a data circuit part. The display panel includes a pixel structure including RGBW sub-pixels. The main circuit part receives RGB data at a first frame frequency, generates RGBW data using the RGB data, and outputs the RGBW data at a second frame frequency greater than the first frame frequency. The data circuit part converts the RGBW data into RGBW data voltages and outputs the RGBW data voltages to the display panel.

Thus, according to exemplary embodiments of the present invention, RGB data at a first frame frequency is converted into RGBW data at a second frame frequency greater than the first frame frequency. The RGBW data at the second frame frequency are displayed on a display panel including an RGBW structure. Therefore, a substantially improved, high resolution image is displayed, while transmittance is also substantially improved. Additionally, power consumption is substantially decreased.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
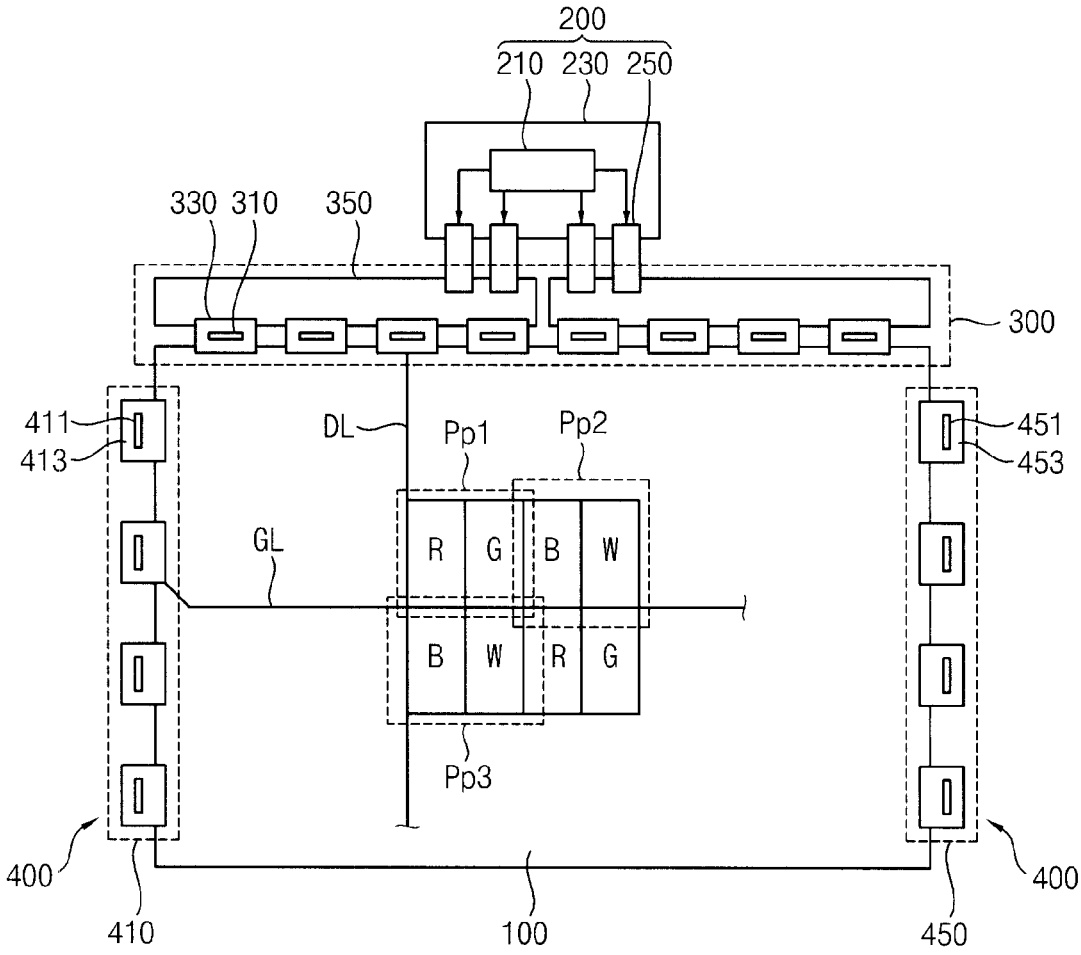
FIG. 1 is a plan view of an exemplary embodiment of a display apparatus according to the present invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the present invention will be described in further detail with reference to the accompanying drawings.

FIG. 1 is a plan view of an exemplary embodiment of a display apparatus according to the present invention.

Referring to FIG. 1, a display apparatus according to an exemplary embodiment includes a display panel 100, a main circuit part 200, a data circuit part 300 and a gate circuit part 400.

The display panel 100 includes data lines DL, gate lines GL and pixels Pp1, Pp2 and Pp3. The data lines DL extend substantially along a first direction, and the gate lines GL extend substantially along a second direction crossing the first direction, e.g., substantially perpendicular to the first direction, as shown in FIG. 1. The pixels Pp1, Pp2 and Pp3 form a red, green, blue and white ("RGBW") structure including a red sub-pixel R, a green sub-pixel G, a blue sub-pixel B and a white sub-pixel W.

In an exemplary embodiment, for example, a first pixel Pp1 of the pixels Pp1, Pp2 and Pp3 includes the red and green sub-pixels R and G, respectively, a second pixel Pp2 of the pixels Pp1, Pp2 and Pp3 adjacent to the first pixel Pp1 along the second direction includes the blue and white sub-pixels B and W, respectively, and a third pixel Pp3 of the pixels Pp1, Pp2 and Pp3 adjacent to the first pixel Pp1 along the first direction includes the blue and white sub-pixels B and W, respectively. The first and second pixels Pp1 and Pp2, respectively, which are adjacent to each other, have the RGBW structure and the first and third pixels Pp1 and Pp3, respectively, which are also adjacent to each other, have the RGBW structure. Therefore, a pixel corresponding to a conventional red, green and blue ("RGB") structure includes three sub-pixels having a red sub-pixel R, a green sub-pixel G and a blue sub-pixel B, but the pixel corresponding to the RGBW structure of an exemplary embodiment of the present invention includes two sub-pixels having a red sub-pixel R and a green sub-pixel G (or, alternatively, a blue sub-pixel B and a white sub-pixel W). Thus the display panel including the RGBW structure according to an exemplary embodiment includes two-thirds a number of sub-pixels of the conventional display panel having the RGB structure. Moreover, the display panel having the RGBW structure according to an exemplary embodiment includes the white sub-pixel W; accordingly, a transmittance is substantially improved, as will be described in further detail below.

Referring still to FIG. 1, the main circuit part 200 includes a main circuit 210, a printed circuit board ("PCB") 230 disposed the main circuit 210 and a flexible printed circuit board ("FPCB") 250 electrically connected to a data circuit part 300. The main circuit 210 receives RGB data at a first frame frequency. The main circuit 210 processes the RGB data using a motion estimation motion compensation ("MEMC") technique, converts the RGB data into RGBW data, and outputs the RGBW data at a second frame frequency greater than the first frame frequency. In an exemplary embodiment, the second frame frequency may be about twice, e.g., two times, the first frame frequency. More specifically, for example, the first frame frequency may be about 60 hertz (Hz) and the second frame frequency may be about 120 Hz in an exemplary embodiment, but alternative exemplary embodiments are not limited thereto.

The data circuit part 300 includes data circuits 310, an FPCB 330 disposed in each of the data circuits 310 and a source PCB 350 electrically connecting the data circuits 310 to the main circuit 210. The data circuits 310 convert the RGBW data into RGBW voltages, which, in an exemplary embodiment are analog voltages, and outputs the RGBW voltages to the data lines DL on a horizontal line unit basis.

The gate circuit part 400 includes a first gate circuit part 410 and a second gate circuit part 450. The first gate circuit part 410 includes first gate circuits 411 and an FPCB 413 disposed in each of the first gate circuits 411. The second gate circuit part 450 includes second gate circuits 451 and an FPCB 453 disposed in each of the second gate circuits 451.

The first and second gate circuits 411 and 451, respectively, sequentially output gate signals to the gate lines GL in response to an output timing of the data circuits 310 according to a control signal from of the main circuit 210. In an exemplary embodiment, for example, each of the first and second gate circuits 411 and 451, respectively, may output the gate signals to the same gate lines at substantially the same time. In an alternative exemplary embodiment, however, the first gate circuits 411 may output the gate signals to odd-numbered gate lines and the second gate circuits 451 may output the gate signals to even-numbered gate lines. Additionally, the first and second gate circuits 411 and 451, respectively, may be integrated on the display panel 100, using a process of forming the pixel on the display panel 100. In addition, the gate circuit part 400 may include only one of the first or second gate circuits 411 or 451, respectively, disposed on a given side of the display panel 100, and may sequentially output the gate signals to gate lines GL, but alternative exemplary embodiments are not limited to the foregoing description.

Figure 2:
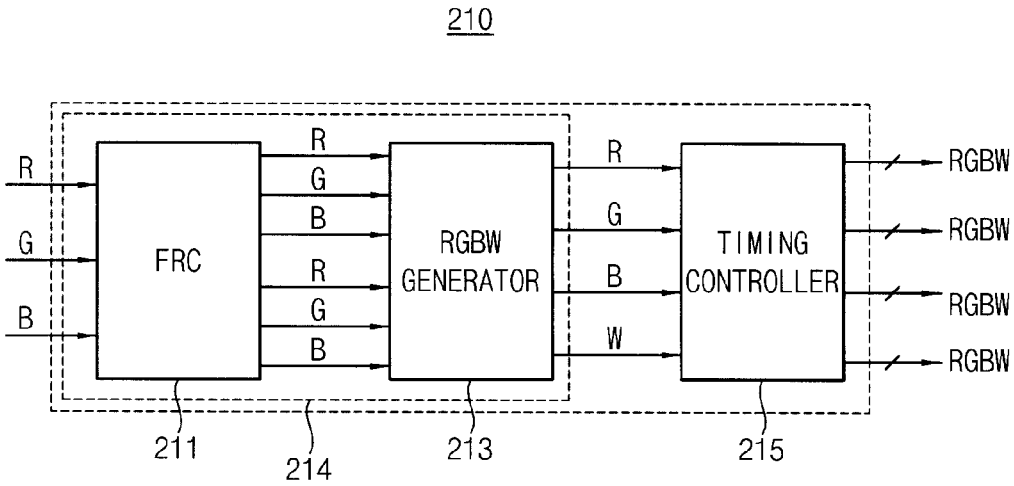
FIG. 2 is a block diagram of a main circuit part of the display apparatus shown in FIG. 1.
Figure 3:
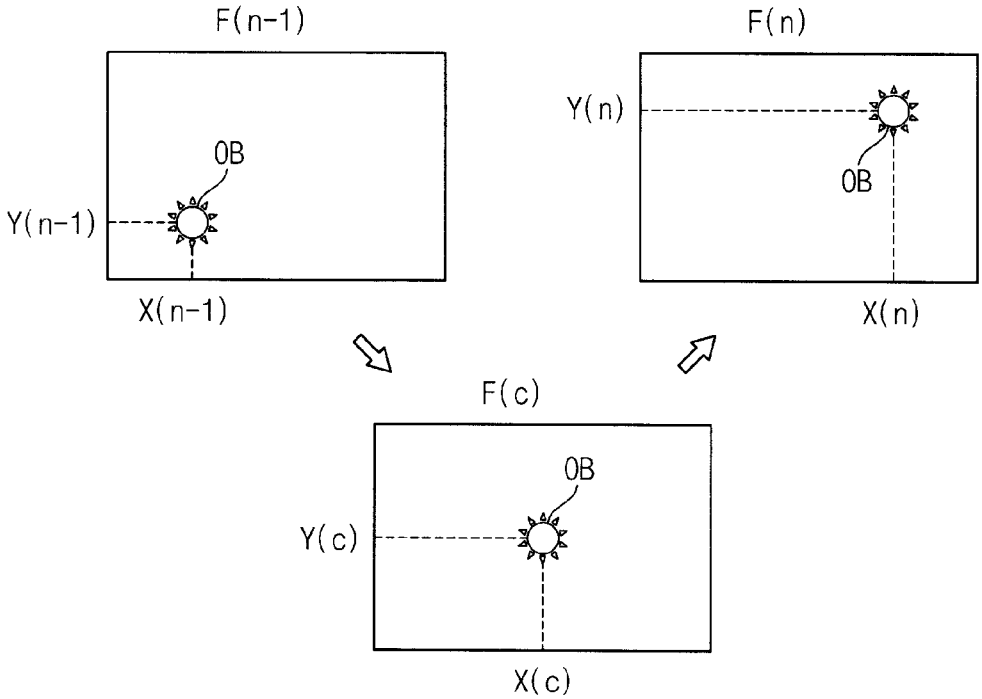
FIG. 3 is a plan view illustrating an exemplary embodiment of a method of using a frame rate controller of the main circuit part shown in FIG. 2.
Figure 4:
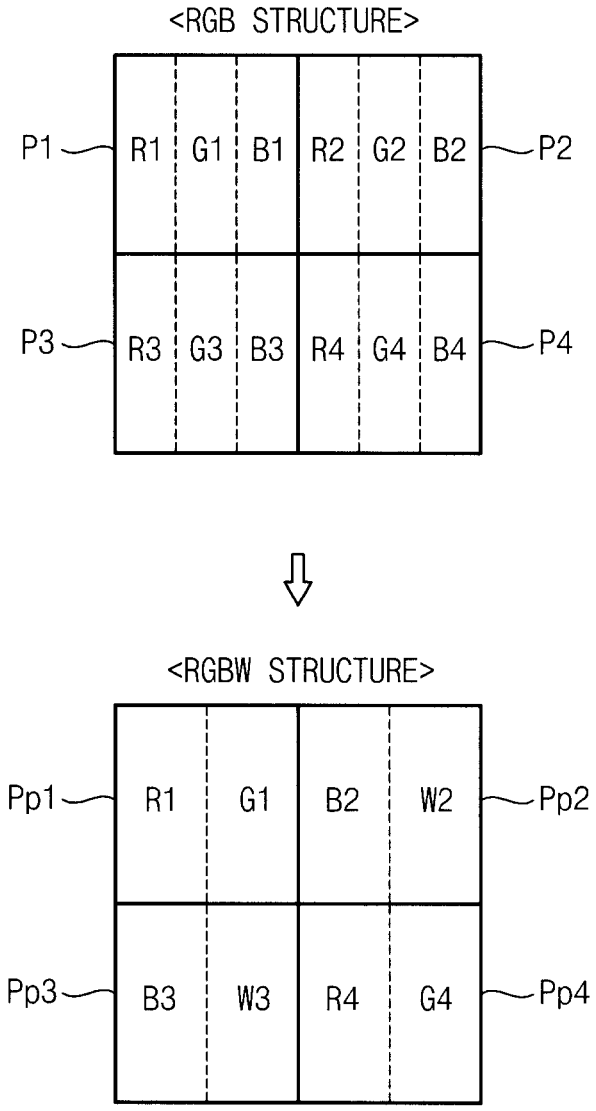
FIG. 4 is a plan view illustrating an exemplary embodiment of a method of using a red, green, blue and white ("RGBW") generator of the main circuit part shown in FIG. 2.

FIG. 2 is a block diagram of the main circuit part 210 of the exemplary embodiment of the display apparatus shown in FIG. 1. FIG. 3 is a plan view illustrating an exemplary embodiment of a method of using a frame rate controller of the main circuit part 210 shown in FIG. 2. FIG. 4 is a plan view illustrating an exemplary embodiment of a method of using an RGBW generator of the main circuit 210 part shown in FIG. 2.

Referring to FIGS. 1 and 2, the main circuit 210 includes a data processing part 214 and a timing controller 215. The data processing part 214 includes a frame rate controller ("FRC") 211 and an RGBW generator 213. The main circuit 210 may be disposed one chip, for example.

The frame rate controller 211 receives the RGB data at the first frame frequency. The frame rate controller 211 processes the RGB data by using the MEMC technique and outputs processed RGB data at the second frame frequency, which is greater than the first frame frequency. In an exemplary embodiment, for example, the frame rate controller 211 receives the RGB data of a high resolution image at a data transmission rate of about 4.455 gigabits per second (Gbps) and outputs the processed RGB data at a data transmission rate of about 8.91 Gbps, but alternative exemplary embodiments are not limited thereto. Hereinafter, the MEMC technique will be described in greater detail with reference to FIG. 3.

Referring to FIG. 3, an object OB is moved from a lower left portion (as viewed in FIG. 3), for example, of a display screen to an upper right portion of the display screen. The object OB has first coordinates $\{X(n-1), Y(n-1)\}$ in an (n−1)-th frame F(n−1), while the object OB has second coordinates $\{X(n), Y(n)\}$ in a subsequent adjacent n-th frame F(n). Thus, as depicted in FIG. 3, the object OB moves from $\{X(n-1), Y(n-1)\}$, corresponding to the lower left portion of an (n−1)-th frame F(n−1), to $\{X(n), Y(n)\}$, corresponding to the upper right portion of an n-th frame F(n).

A horizontal motion vector of the object OB is determined based on a difference between an x-coordinate of the n-th frame F(n) and an x-coordinate of the (n−1)-th frame F(n−1). Likewise, a vertical motion vector of the object OB is determined based on a difference between a y-coordinate of the n-th frame F(n) and a y-coordinate of the (n−1)-th frame F(n−1). The horizontal motion vector may include direction information and/or speed information (with respect to an x-axis direction in which the object OB moves). The vertical motion vector may include direction information and/or speed information (with respect to a y-axis direction in which the object OB moves.

When the horizontal motion vector and the vertical motion vector are obtained, motion of the object OB is estimated based the horizontal motion vector and the vertical motion vector. Moreover, the motion of the object OB is compensated by using the estimated motion of the object OB. Accordingly, a motion compensation frame F(c) is generated by using coordinates $\{X(c), Y(c)\}$ of the compensated motion of the object OB. In an exemplary embodiment, the motion compensation frame F(c) is inserted between the (n−1)-th frame F(n−1) and the n-th frame F(n).

As a result, the frame rate controller 211 inserts the motion compensation frame F(c) into between the (n−1)-th frame F(n−1) and the n-th frame F(n), and the second frame frequency is increased to be two times greater than the first frame frequency. As discussed above, in an exemplary embodiment, for example, the first frame frequency is about 60 Hz and the second frame frequency is about 120 Hz. It will be noted that, although one motion compensation frame F(c) is inserted into between the (n−1)-th frame F(n−1) and the n-th frame F(n) in FIG. 3, alternative exemplary embodiments are not limited thereto. For example, the frame rate controller 211 according to an alternative exemplary embodiment may insert one or more motion compensation frames F(c), including the object OB disposed at a middle position between the first and second coordinates $\{X(n-1), Y(n-1)\}$ and $\{X(n), Y(n)\}$. Additionally, the frame rate controller 211 according to another alternative exemplary embodiment may generate a plurality of the motion compensation frames including the object OB respectively disposed at multiple positions, e.g., a ¼ position and a ¾ position of the first and second coordinates $\{X(n-1), Y(n-1)\}$ and $\{X(n), Y(n)\}$, respectively.

In an exemplary embodiment, the RGBW generator 213 receives the RGB data from the frame rate controller 211 at the second frame frequency and generates the RGBW data using the RGB data received from the frame rate controller 211. In an exemplary embodiment, for example, the RGBW generator 213 receives the RGB data at a data transmission rate of about 8.91 Gbps and outputs the RGBW data at a data transmission rate of about 5.94 Gbps. Hereinafter, an exemplary embodiment of a method of generating the RGBW data using the RGB data will be described with reference to FIG. 4.

Referring to FIG. 4, the RGB data corresponds to a conventional display panel having the RGB structure. More particularly, for example, a first pixel P1 includes first pixel data including first red data R1, first green data G1 first blue data B1. Likewise, each of a second pixel P2, a third pixel P3 and a fourth pixel P4 includes associated pixel data comprising the RGB data.

In contrast, the RGBW data according to an exemplary embodiment corresponds to the display panel having the RGBW structure. More specifically, for example, a first pixel Pp1 includes first pixel data including first red data R1 and first green data G1, and a second pixel Pp2 includes second pixel data including second blue data B2 and a second white data W2. Thus, a third pixel Pp3 includes third pixel data including third blue data B3 and a third white data W3, and a fourth pixel Pp4 includes fourth pixel data including fourth red data R4 and fourth green data G4.

The RGBW generator 213 according to an exemplary embodiment converts the RGB data of the RGB structure into the RGBW data of the RGBW structure. For example, the RGBW generator 213 converts first RGB data corresponding into RGB sub-pixels R1, G1 and B1 of the first pixel P1 to first RG data corresponding to red and green sub-pixels R1 and G1 of the first pixel Pp1. Additionally, the RGBW generator 213 converts second RGB data corresponding to RGB sub-pixels R2, G2 and B2 of the second pixel P2 into second BW data corresponding to blue and white sub-pixels B2 and W2 of the second pixel Pp2. Likewise, the RGBW generator 213 converts third RGB data corresponding to RGB sub-pixels R3, G3 and B3 of the third pixel P3 into third BW data corresponding to blue and white sub-pixels B3 and W3 of the third pixel Pp3. Similarly, the RGBW generator 213 converts fourth RGB data corresponding to RGB sub-pixels R4, G4 and B4 of the fourth pixel P4 into fourth RG data corresponding to red and green sub-pixels R4 and G4 of the fourth pixel Pp4.

As a result, the RGBW generator 213 according to an exemplary embodiment generates the RGBW data, and amount of the RGBW data that is about two-thirds of an amount of the RGB data, thereby substantially improving an operating speed and/or efficiency of a display device according to an exemplary embodiment.

The timing controller 215 receives the RGBW data, and outputs the RGBW data on a horizontal line basis to the data circuit part 300. In an exemplary embodiment, for example, the timing controller 215 receives the RGBW data at a data transmission rate of about 5.94 Gbps, but alternative exemplary embodiments are not limited thereto.

In an exemplary embodiment, which includes a transistor-to-transistor level ("TTL") interface method, a data transmission rate and number of pins of each of the frame rate controller 211 and the RGBW generator 213 are shown in Table 1 below.

TABLE 1

| | Input Data Transmission Rate | Output Data Transmission Rate | Number of Input Pins | Number of Output Pins |
|---|---|---|---|---|
| Frame rate controller | 4.455 Gbps | 8.91 Gbps | 64 | 124 |
| RGBW generator | 8.91 Gbps | 5.94 Gbps | 124 | 84 |

Referring to Table 1, an input part of the frame rate controller 211 includes input pins including data input pins and control input pins, and a number of the input pins is about 64. For example, each of RGB data is received using two channels, and each of the channels is allocated to 10 pins; accordingly; the number of the data input pins is 60. The control input pins are allocated to 4 pins that correspond to a horizontal synchronization signal, a vertical synchronization signal, a data enable signal and a clock signal. An output part of the frame rate controller 211 includes output pins including data output pins and control output pins, and a number of the output pins is about 124. An output frequency of the frame rate controller 211, e.g., the second frame frequency, is about two times an input frequency of the frame rate controller 211, e.g., the first frame frequency, and the data output pins are therefore allocated to 120 pins, e.g., about two times the number of data input pins (which is 60). The control output pins are allocated to 4 pins, which is the same number as the control input pins, described above.

An input part of the RGBW generator 213 includes input pins including data input pins and control input pins, and a number of the input pins is about 124. The RGBW generator 213 receives the RGB data and control signals from the frame rate controller 211; accordingly, the number of the input pins is substantially the same as the number of the output pins of the frame rate controller 211, e.g., 124 pins. An output part of the RGBW generator 213 includes output pins including data output pins and control output pins, and a number of the output pins is about 84. Output data of the RGBW generator 213 is about two-thirds an amount of input data of the RGBW generator 213; accordingly, the output-data pins are allocated to 80 pins (e.g., $120\times2/3=80$). The output control pins are allocated to 4 pins, as described above.

Figure 5:
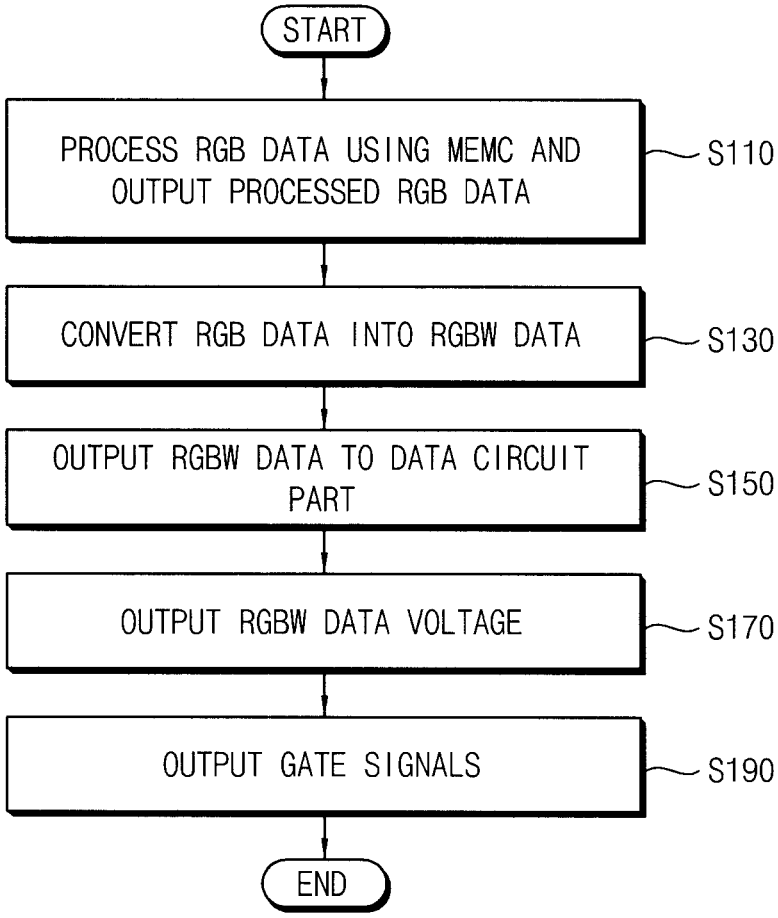
FIG. 5 is a flowchart illustrating an exemplary embodiment of a method for driving the display apparatus shown in FIG. 1.

FIG. 5 is a flowchart illustrating an exemplary embodiment of a method for driving the display apparatus shown in FIG. 1.

Referring to FIGS. 1, 2 and 5, in step S110 the frame rate controller 211 according to an exemplary embodiment receives the RGB data at the first frame frequency, processes the RGB data using MEMC, and outputs processed RGB data at the second frame frequency. In an exemplary embodiment, for example, the frame rate controller 211 receives the RGB data of a high resolution image at a data transmission rate of about 4.455 Gbps, and outputs the RGB data, processed using MEMC, at a data transmission rate of about 8.91 Gbps, but alternative exemplary embodiments are not limited thereto.

In step S130, the RGBW generator 213 receives the RGB data from the frame rate controller 211 at the second frame frequency, converts the RGB data into the RGBW data, and outputs the RGBW data (that is about two-thirds the amount of the RGB data). In an exemplary embodiment, for example, the RGBW generator 213 receives the RGB data at a data transmission rate of about 8.91 Gbps and outputs the RGBW data at a data transmission rate of about 5.94 Gbps, but alternative exemplary embodiments are not limited thereto.

In step S150, the timing controller 215 receives the RGBW data and outputs the RGBW data to the data circuit part 300 on a horizontal line basis. In an exemplary embodiment, for example, the timing controller 215 receives the RGBW data at a data transmission rate of about 5.94 Gbps, but alternative exemplary embodiments are not limited thereto.

In step S170, the data circuit part 300 converts the RGBW data received from the timing controller 215 into the analog RGBW data voltage and outputs the analog RGBW data voltage to the data lines DL based on horizontal synchronization signal.

In step S190, the gate circuit part 400 sequentially outputs the gate signals to the gate lines GL based on the vertical synchronization signal according to a control signal from the timing controller 215.

Figure 6:
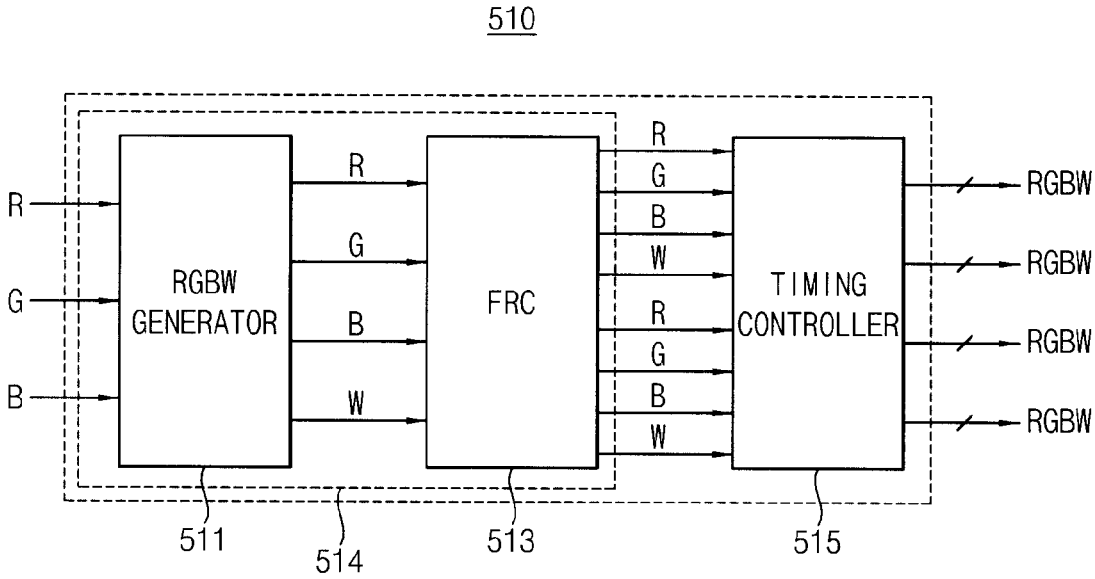
FIG. 6 is a block diagram of an alternative exemplary embodiment of a main circuit according to the present invention.
Figure 7:
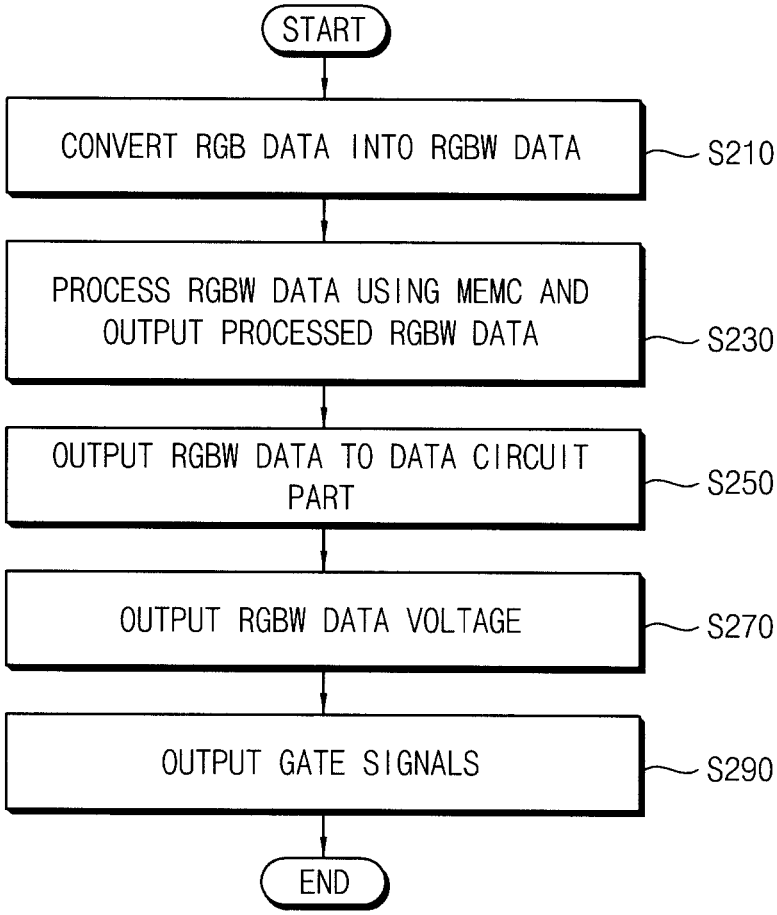
FIG. 7 is a flowchart illustrating an exemplary embodiment of a method for driving a display apparatus including the main circuit shown in FIG. 6.

FIG. 6 is a block diagram of an alternative exemplary embodiment of a main circuit according to the present invention. FIG. 7 is a flowchart illustrating an exemplary embodiment of a method for driving a display apparatus including the main circuit shown in FIG. 6. Hereinafter, the same reference characters will be used to refer to the same or like components as those described in greater detail above with reference to alternative exemplary embodiments shown in FIGS. 1-5, and any repetitive detailed explanation thereof will be omitted.

Referring to FIGS. 1, 6 and 7, a main circuit 510 according to an alternative exemplary embodiment includes a data processing part 514 and a timing controller 515. The data processing part 514 includes an RGBW generator 511 and a frame rate controller 513. The main circuit 510 may be disposed on one chip, e.g., a single chip may be formed to include the main circuit 510 therein.

The RGBW generator 511 receives RGB data at a first frame frequency, generates RGBW data (that is about two-thirds the amount of the RGB data), and outputs the RGBW data (step S210). In an exemplary embodiment, for example, the RGBW generator 511 receives the RGB data at a data transmission rate of about 4.455 Gbps and outputs the RGBW data at a data transmission rate of about 2.97 Gbps, but alternative exemplary embodiments are not limited thereto.

The frame rate controller 513 receives the RGBW data at the first frame frequency, processes the RGBW data using MEMC, and outputs processed RGBW data at a second frame frequency, which is greater than the first frame frequency (step S230). IN an exemplary embodiment, for example, the frame rate controller 513 receives the RGBW data at a data transmission rate of about 2.97 Gbps and outputs the processed RGBW data at a data transmission rate of about 5.94 Gbps, but alternative exemplary embodiments are not limited thereto.

The timing controller 515 receives the RGBW data and outputs the RGBW data to the data circuit part 300 on a horizontal line basis (step S250). In an exemplary embodiment, for example, the timing controller 515 receives the RGBW data at a data transmission rate of about 5.94 Gbps, but alternative exemplary embodiments are not limited thereto.

The data circuit part 300 converts the RGBW data received from the timing controller 215 into the analog RGBW data voltage and outputs the analog RGBW data voltage to the data lines based on a horizontal synchronization signal (step S270).

The gate circuit part 400 sequentially outputs the gate signals to the gate lines GL based on the vertical synchronization signal according to a control signal of the timing controller 215 (step S290).

In an exemplary embodiment, which includes a TTL interface method, the data transmission rate and the number of pins of each of the frame rate controller 513 and the RGBW generator 511 are as shown in Table 2.

TABLE 2

| | Input Data Transmission Rate | Output Data Transmission Rate | Number of Input Pins | Number of Output pins |
|---|---|---|---|---|
| Frame rate controller | 2.97 Gbps | 5.94 Gbps | 44 | 84 |
| RGBW generator | 4.455 Gbps | 2.97 Gbps | 64 | 44 |

Referring to Table 2, an input part of the RGBW generator 511 includes input pins including data input pins and control input pins, and a number of the input pins is about 64. In an exemplary embodiment, for example, each of RGB data is received using two channels, and each of the channels is allocated to 10 pins; as a result, the number of the data input pins is 60. The control input pins are allocated to 4 pins that correspond to a horizontal synchronization signal, a vertical synchronization signal, a data enable signal and a clock signal. An output part of the RGBW generator 511 includes output pins including data output pins and control output pins, and a number of the output pins is about 44. Output data of the RGBW generator 511 is about two-thirds the amount of input data of the RGBW generator 511; accordingly, the output data pins are allocated to 40 pins ($60\times\frac{2}{3}=40$). The output-control pins are allocated to 4 pins, as described above.

An input part of the frame rate controller 513 includes input pins including data input pins and control input pins, and a number of the input pins is about 44. The frame rate controller 513 receives the RGB data and control signals from the RGBW generator 511 such that the number of the input pins is substantially the same as the number of the output pins of the RGBW generator 511. An output part of the frame rate controller 513 includes output pins including data output pins and control output pins, and a number of the output pins is about 84. In an exemplary embodiment, an output frequency of the frame rate controller 513, e.g., the second frame frequency, is two times an input frequency of the frame rate controller 513, e.g., the first frame frequency, and the data output pins are thereby allocated to 80 pins, e.g., two times the number of data input pins (which in an exemplary embodiment is 40, as shown in Table 2). The control output pins are allocated to 4 pins, which is the same number as that of the control input pins.

By comparing Table 1 with Table 2, above, relationships between the data transmission rate and the number of pins of each of the frame rate controller and the RGBW generator may be expressed as shown in Table 3 and Table 4, below.

TABLE 3

| Input/Output Data Transmission Rate (Gbps) | | | |
|---|---|---|---|
| | Table 1 | Table 2 | Comparison |
| Frame rate controller | 4.455/8.91 | 2.97/5.94 | Table 2 is about ⅔ of Table 1 |
| RGBW generator | 8.91/5.94 | 4.455/2.97 | Table 2 is about ½ of Table 1 |

TABLE 4

| Number of Input/Output Pins | | | |
|---|---|---|---|
| | Table 1 | Table 2 | Comparison |
| Frame rate controller | 64/124 | 44/84 | Table 2 is about 60 less than Table 1 |
| RGBW generator | 124/84 | 64/44 | Table 2 is ½ of Table 1 |

Thus, as shown in Tables 3 and 4, the data transmission rate of the frame rate controller according to the exemplary embodiment of Table 2 is about two-thirds that of the frame rate controller according to Table 1, and the number of the data pins of the frame rate controller according to Table 2 is about 60 less than the that of the frame rate controller according to Table 1. Put another way, data throughput of the frame rate controller 513 according to an exemplary embodiment shown in FIG. 6 is one-third less than that of the frame rate controller 211 according to the exemplary embodiment show in FIG. 2. Additionally, the data transmission rate of the RGBW generator according to Table 2 was about half that of the RGBW generator according to Table 1 and the number of the data pins of the RGBW generator according to Table 2 was about half that of the RGBW generator according to Table 1. Thus, the data throughput of the RGBW generator 511 according to the exemplary embodiment shown in FIG. 6 is about half less than that of the RGBW generator 213 according to the exemplary embodiment shown in FIG. 2.

Therefore, the main circuit part 510 according to an exemplary embodiment shown in FIG. 6 includes additional advantages which include, but are not limited to, substantially improved data throughput and reduced number of the data pins. Thus, the main circuit part 510 requires a substantially reduced logic size. Accordingly, manufacturing costs are substantially decreased.

According to exemplary embodiments of the present invention as described herein, RGB data at a first frame frequency are converted into RGBW data at a second frame frequency greater than the first frame frequency. The RGBW data at the second frame frequency are displayed on a display panel including an RGBW structure. Therefore, a high resolution image, e.g., an image displayed at a substantially improved resolution, is displayed, while transmittance is substantially improved, as well. Additionally, power consumption is substantially decreased.

The present invention should not be construed as being limited to the exemplary embodiments set forth herein. Rather, these exemplary embodiments are provided so that this disclosure will be thorough and complete and will fully convey the concept of the present invention to those skilled in the art. Rather, the foregoing is illustrative of exemplary embodiments of the present invention and is not to be construed as limiting thereof. Although exemplary embodiments of the present invention have been described, those of ordinary skill in the art will appreciate that modifications of the exemplary embodiments described herein may be made without departing from the spirit or scope of the present invention as defined by the following claims.

What is claimed is:

1. A method of processing data for driving a display panel including a pixel structure comprising red, green, blue and white sub-pixels, the method comprising:

receiving red, green and blue data having a first frame frequency;

converting the red, green and blue data into converted red, green, blue and white data; and processing the converted red, green, blue and white data to have a second frame frequency which is greater than the first frame frequency, wherein a data transmission rate of the red, green and blue data is greater than a data transmission rate of the converted red, green, blue and white data, due to a reduced data amount of the converted red, green, blue and white data.

2. The method of claim 1, wherein the second frame frequency is about two times the first frame frequency.

3. The method of claim 2, wherein the first frame frequency is about 60 hertz and the second frame frequency is about 120 hertz.

4. The method of claim 1, wherein the generating the red, green, blue and white data comprises:

processing the red, green and blue data at the first frame frequency using motion estimation motion compensation to generate processed red, green and blue data; and converting the processed red, green and blue data into the red, green, blue and white data at the second frame frequency.

5. The method of claim 4, wherein a data transmission rate of the red, green and blue data is less than a data transmission rate of the processed red, green and blue data.

6. The method of claim 5, wherein a data transmission rate of the processed red, green and blue data is greater than a data transmission rate of the red, green, blue and white data converted from the processed red, green and blue data.

7. The method of claim 1, wherein the processing the converted red, green, blue and white data comprises:

generating the red, green, blue and white data having the second frame frequency using motion estimation motion compensation.

8. The method of claim 1, wherein a data transmission rate of the converted red, green, blue and white data is less than a data transmission rate of the converted red, green, blue and white data processed using motion estimation motion compensation.

9. A data processing device comprising:

a frame rate controller which receives red, green and blue data at a first frame frequency, processes the red, green and blue data using motion estimation motion compensation to generate processed red, green and blue data and outputs the processed red, green and blue data at a second frame frequency; and a red, green, blue and white generator which converts the processed red, green and blue data into red, green, blue and white data, wherein the second frame frequency is greater than the first frame frequency, wherein a data transmission rate of the red, green, and blue data is greater than a data transmission rate of the converted red, green, blue and white data, due to a reduced data amount of the converted red, green, blue and white data.

10. A data processing device comprising:

a red, green, blue and white generator which receives red, green and blue data having a first frame frequency and converts the red, green and blue data into converted red, green, blue and white data; and a frame rate controller which processes the converted red, green, blue and white data having a second frame frequency using motion estimation motion compensation and outputs the processed red, green, blue and white data, wherein the second frame frequency is greater than the first frame frequency, wherein a data transmission rate of the red, green and blue data is greater than a data transmission rate of the converted red, green, blue and white data, due to a reduced data amount of the converted red, green, blue and white data.

11. A display apparatus comprising:

a display panel comprising a pixel structure including red, green, blue and white sub-pixels;

a main circuit part which receives red, green and blue data having a first frame frequency, generates red, green, blue and white data having a second frame frequency using the red, green and blue data and outputs the red, green, blue and white data, wherein the second frame frequency is greater than the first frame frequency; and a data circuit part which converts the red, green, blue and white data into red, green, blue and white data voltages and outputs the red, green, blue and white data voltages to the display panel, wherein a data transmission rate of the red, green and blue data is greater than a data transmission rate of the converted red, green, blue and white data, due to a reduced data amount of the converted red, green, blue and white data.

12. The display apparatus of claim 11, wherein the second frame frequency is about two times the first frame frequency.

13. The display apparatus of claim 12, wherein the first frame frequency is about 60 hertz and the second frame frequency is about 120 hertz.

14. The display apparatus of claim 11, wherein the main circuit part comprises:

a frame rate controller which receives the red, green and blue data at the first frame frequency, processes the red, green and blue data using motion estimation motion compensation to generate processed red, green and blue data and outputs the processed red, green and blue data at the second frame frequency; and a red, green, blue and white generator which converts the processed red, green and blue data into the red, green, blue and white data.

15. The display apparatus of claim 14, wherein the frame rate controller includes first data input pins and first data output pins, and a number of the first data output pins is greater than a number of the first data input pins.

16. The display apparatus of claim 15, wherein the red, green, blue and white generator includes second data input pins and second data output pins, and a number of the second data input pins is substantially the same as the number of the first data output pins of the frame rate controller and greater than a number of the second data output pins of the red, green, blue and white generator.

17. The display apparatus of claim 11, wherein the main circuit part includes:

a red, green, blue and white generator which receives the red, green and blue data having the first frame frequency and converts the red, green and blue data into the red, green, blue and white data; and a frame rate controller which processes the red, green, blue and white data having the second frame frequency using motion estimation motion compensation and outputs the processed red, green, blue and white data.

18. The display apparatus of claim 17, wherein the red, green, blue and white generator includes first data input pins and first data output pins, and a number of the first data input pins is greater than a number of the first data output pins.

19. The display apparatus of claim 18, wherein the frame rate controller includes second data input pins and second data output pins, and a number of the second data input pins is substantially the same as the number of the first data output pins and less than a number of the second data output pins.

* * * * *